US010177483B1

(12) United States Patent
Horning et al.

(10) Patent No.: US 10,177,483 B1
(45) Date of Patent: Jan. 8, 2019

(54) ELECTRICAL CONNECTOR ASSEMBLY WITH IMPEDANCE CONTROL AT MATING INTERFACE

(71) Applicant: TE CONNECTIVITY CORPORATION, Berwyn, PA (US)

(72) Inventors: Michael James Horning, Landisville, PA (US); Matthew Jeffrey Sypolt, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/889,646

(22) Filed: Feb. 6, 2018

(51) Int. Cl.

| | |
|---|---|
| ***H01R 13/625*** | (2006.01) |
| ***H01R 13/502*** | (2006.01) |
| ***H01R 12/73*** | (2011.01) |
| ***H01R 13/52*** | (2006.01) |
| ***H01R 13/6473*** | (2011.01) |
| *H01R 13/514* | (2006.01) |

(52) U.S. Cl.
CPC ..... *H01R 13/5025* (2013.01); *H01R 12/737* (2013.01); *H01R 13/5219* (2013.01); *H01R 13/6473* (2013.01); *H01R 13/514* (2013.01)

(58) Field of Classification Search
CPC ..... H01R 13/6275; H01R 13/639; H01R 23/7005; H01R 13/62933
USPC ..... 439/345, 953, 378, 372
See application file for complete search history.

(56) References Cited

U.S. PATENT DOCUMENTS

| | | | | |
|---|---|---|---|---|
| 4,386,814 A * | 6/1983 | Asick | H01R 13/648 | 439/607.28 |
| 4,983,127 A * | 1/1991 | Kawai | H01R 13/658 | 439/79 |
| 5,195,911 A * | 3/1993 | Murphy | H01R 13/6582 | 439/607.53 |
| 5,288,248 A * | 2/1994 | Chen | H01R 13/658 | 439/607.19 |
| 6,206,731 B1 * | 3/2001 | Kuo | H01R 13/741 | 439/553 |
| 8,444,434 B2 | 5/2013 | Davis et al. | | |
| 8,662,924 B2 | 3/2014 | Davis et al. | | |
| 8,715,003 B2 | 5/2014 | Buck et al. | | |

* cited by examiner

*Primary Examiner* — Phuong Chi T Nguyen

(57) ABSTRACT

An electrical connector assembly includes a module stack, a front housing, and a spring member. The module stack includes multiple contact modules disposed side by side. The module stack includes multiple signal contacts that project beyond a front side thereof. The front housing is mechanically coupled to the module stack at the front side and surrounds the signal contacts. The front housing defines cavities that receive mating contacts of a mating connector to engage the signal contacts. The front housing is movable relative to the module stack along a longitudinal axis of the electrical connector assembly between a retracted position and an extended position. The spring member is held between the module stack and the front housing. The spring member engages the module stack and the front housing to bias the front housing towards the extended position.

20 Claims, 10 Drawing Sheets

ELECTRICAL CONNECTOR ASSEMBLY WITH IMPEDANCE CONTROL AT MATING INTERFACE

BACKGROUND OF THE INVENTION

The subject matter herein relates generally to electrical connector assemblies, and more specifically to electrical connector assemblies that are configured to control impedance at a mating interface between the electrical connector assembly and a mating connector when both fully mated and only partially mated.

Some electrical systems, such as server systems and the like, utilize connector assemblies, such as header assemblies and receptacle assemblies, to interconnect circuit boards, such as a motherboard and daughtercard. The electrical systems may be relatively complex. For example, multiple connector assemblies mounted on a common circuit board may mate to corresponding mating connectors on different circuit boards. In addition, at least some of the circuit boards may be mounted to walls of a chassis, which fixes the circuit boards in place within the electrical system.

When the electrical system is assembled, the connector assemblies are mated to connect the different circuit boards. Two mating electrical connector assemblies are considered to be fully mated when signal and ground contacts of the first connector assembly engage corresponding signal and ground contacts of the second connector assembly and a mating surface of a housing of the first connector assembly abuts against a mating surface of a housing of the second connector assembly. The interface between the mating surfaces represents a mating interface. The signal and ground contacts extend across the mating interface.

Typically, at least some of the mating connector assemblies in electrical systems may not be able to fully mate when the electrical system is assembled and are only partially mated. Mating connector assemblies are considered to be partially mated to one another when the signal and ground contacts of the two connector assemblies are engaged but the mating surfaces of the housings do not abut against one another, resulting in an air gap at the mating interface. The air gap at the mating interface may be the result of various factors, including aggregated tolerances between components within the system, bowed circuit boards, imprecise assembly of the system, and the like. For example, if a circuit board is bowed instead of planar, a first connector mounted on the bowed circuit board may be able to fully mate to a corresponding mating connector on another circuit board, but a second connector adjacent to the first connector may be located farther away from the other circuit board than the first connector due to the curved circuit board. As a result, the second connector is only able to partially mate to a corresponding mating connector on the other circuit board.

Although partial mating of connector assemblies allows signal transmission across the connector assemblies, the air gap at the mating interface causes an impedance discontinuity, which may degrade signal quality and/or signal strength relative to fully-mated connector assemblies that lack an air gap at the mating interface (or at least have smaller air gaps at the mating interface). For example, the impedance discontinuity may cause some of the electrical energy along the signal path to reflect back to the source instead of being transmitted across the connector assemblies. The signal degradation caused by the impedance discontinuity at the mating interface may be exacerbated at high signal transmission speeds, such as speeds over 10 Gb/s.

A need remains for electrical connector assemblies with improved electrical performance (e.g., electrical signal transmission) at high speeds by improving impedance control at the mating interface regardless of whether mating connector assemblies are able to be fully mated or only partially mated.

BRIEF DESCRIPTION OF THE INVENTION

In one or more embodiments, an electrical connector assembly is provided that includes a module stack, a front housing, and a spring member. The module stack includes multiple contact modules disposed side by side. The module stack has a front side and a rear side opposite the front side. The module stack including multiple signal contacts that project beyond the front side. The front housing is mechanically coupled to the module stack at the front side and surrounds the signal contacts. The front housing defines cavities that are open along a front end of the front housing. The cavities are configured to receive mating contacts of a mating connector through the front end to engage the signal contacts. The front housing is movable relative to the module stack along a longitudinal axis of the electrical connector assembly between a retracted position and an extended position. The spring member is held between the module stack and the front housing. The spring member engages the module stack and the front housing and biases the front housing towards the extended position.

In one or more embodiments, an electrical connector assembly is provided that includes a module stack, a front housing, and a spring member. The module stack includes multiple contact modules disposed side by side. The module stack has a front side and a rear side opposite the front side. The module stack including multiple signal contacts that project beyond the front side. The front housing is mechanically coupled to the module stack at the front side and surrounds the signal contacts. The front housing defines cavities that are open along a front end of the front housing. The cavities are configured to receive mating contacts of a mating connector through the front end to engage the signal contacts. The front housing is movable relative to the module stack along a longitudinal axis of the electrical connector assembly between a retracted position and an extended position. The spring member is mounted to the front housing. The spring member engages the front side of the module stack and exerts a biasing force on the front side to bias the front housing towards the extended position.

In one or more embodiments, an electrical connector assembly is provided that includes a module stack, a front housing, and a spring member. The module stack includes multiple contact modules disposed side by side. The module stack has a front side and a rear side opposite the front side. The module stack including multiple signal contacts that project beyond the front side. The front housing is mechanically coupled to the module stack at the front side and surrounds the signal contacts. The front housing defines cavities that are open along a front end of the front housing. The cavities are configured to receive mating contacts of a mating connector through the front end to engage the signal contacts. The front housing is movable relative to the module stack along a longitudinal axis of the electrical connector assembly between a retracted position and an extended position. The spring member is mounted to the module stack. The spring member engages the front housing and exerts a biasing force on the front housing to bias the front housing towards the extended position.

DETAILED DESCRIPTION OF THE INVENTION

Figure 1:
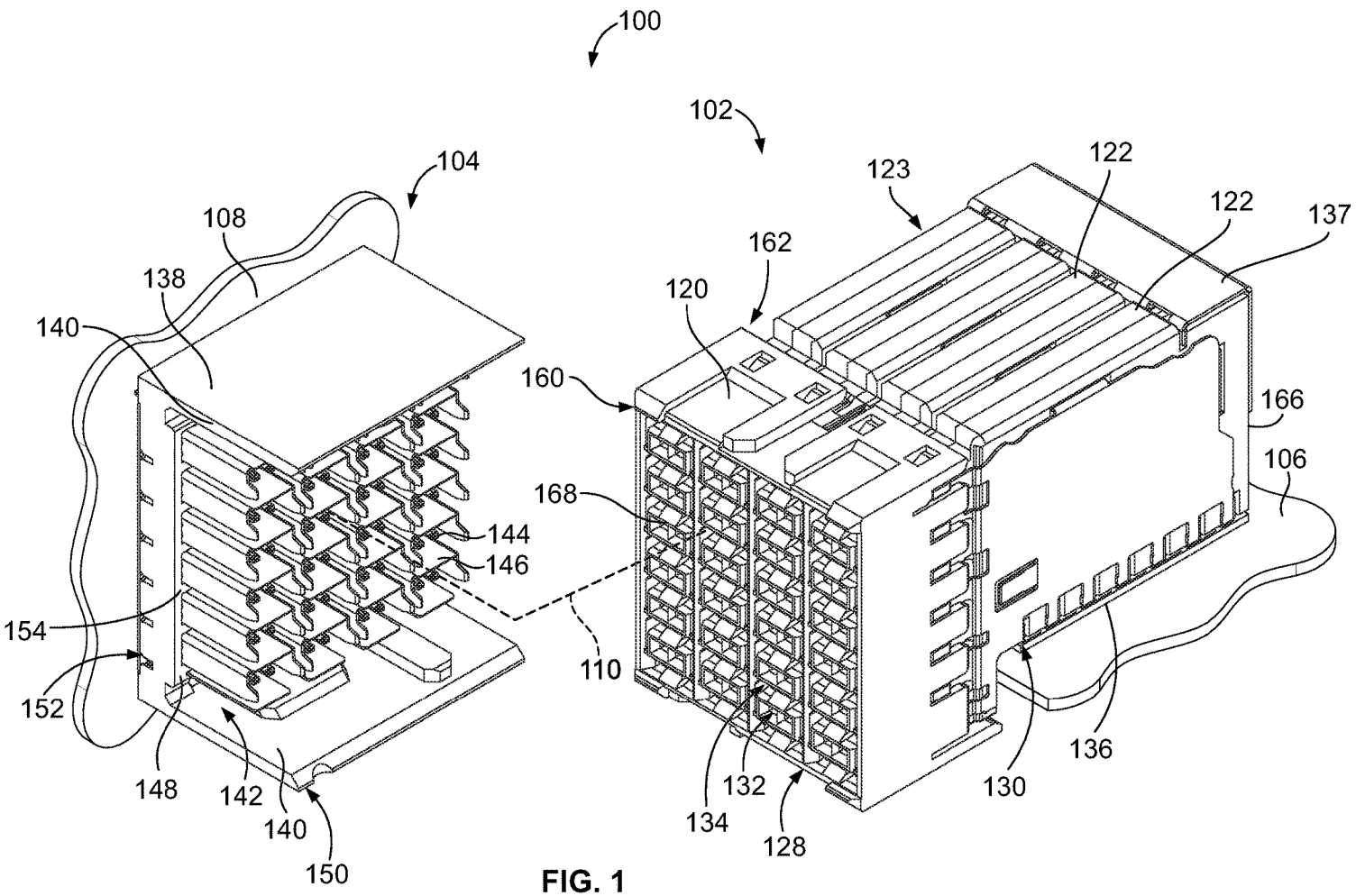
FIG. 1 is a perspective view of an electrical connector system according to an embodiment that includes a receptacle connector assembly and a header connector assembly.

FIG. 1 is a perspective view of an electrical connector system 100 formed in accordance with an embodiment. The connector system 100 includes first and second connector assemblies 102, 104 that are configured to be mated to each other to provide an electrically conductive signal path across the connector assemblies 102, 104. In the illustrated embodiment, the first connector assembly 102 is a receptacle connector assembly referred to hereinafter as "receptacle connector assembly" and "receptacle assembly", and the second connector assembly 104 is a header connector assembly referred to hereinafter as "header connector assembly" and "header assembly". The receptacle and header assemblies 102, 104 are electrically connected to respective first and second circuit boards 106, 108, and are utilized to electrically connect the first and second circuit boards 106, 108 to one another. A mating axis 110 extends through the receptacle and header assemblies 102, 104. The receptacle and header assemblies 102, 104 are mated together in a direction parallel to and along the mating axis 110.

In the illustrated embodiment, the first circuit board 106 is oriented perpendicular to the second circuit board 108 when the receptacle and header assemblies 102, 104 are mated. For example, the receptacle assembly 102 is a right angle connector, such that a mating end 128 of the receptacle assembly 102 is oriented generally perpendicular (e.g., within five degrees or within 10 degrees of a right angle) relative to the first circuit board 106. The header assembly 104 is an in-line connector in FIG. 1. Alternative orientations of the circuit boards 106, 108 are possible in alternative embodiments. For example, the circuit boards 106, 108 may be oriented parallel to each other on opposite sides of the mated receptacle and header assemblies 102, 104. Such parallel arrangement may be possible in an embodiment in which both the receptacle and header assemblies 102, 104 are in-line connectors (or when both assemblies 102, 104 are right angle connectors).

The receptacle assembly 102 includes a front housing 120 that holds a plurality of contact modules 122. The contact modules 122 are held in a stacked configuration generally parallel to one another. The contact modules 122 define a module stack 123 that is loaded into the front housing 120. The module stack 123 projects rearward from the front housing 120. Any number of contact modules 122 may be provided in the module stack 123. The contact modules 122 each include a plurality of signal conductors (not shown) that define signal paths through the receptacle assembly 102.

The receptacle assembly 102 includes a mating end 128 and a mounting end 130. Since the receptacle assembly 102 is a right angle connector in the illustrated embodiment, the mating end 128 is oriented generally perpendicular to the orientation of the mounting end 130. The mating end 128 engages the header assembly 104 during a mating operation. The mounting end 130 is mechanically coupled to, and electrically connected to, the circuit board 106. The signal conductors extend through the receptacle assembly 102 from the mounting end 130, where the signal conductors terminate to the circuit board 106, towards the mating end 128.

The contact modules 122 in the module stack 123 may be secured in place relative to one another via a pin organizer 136 between the mounting end 130 and the circuit board 106 and/or a coupling clip 137, such that the module stack 123 forms an unitary structure. The front housing 120 may also hold the adjacent contact modules 122 together.

The front housing 120 has a front end 160 and a rear end 162 that is opposite the front end 160. The module stack 123 has a front side 164 (shown in FIG. 2) and a rear side 166 opposite the front side 164. As used herein, relative or spatial terms such as "front," "rear," "top," and "bottom," are only used relative to, and to distinguish, the referenced elements in the illustrated orientations and do not necessarily require particular positions or orientations relative to the surrounding environment of the connector system 100. The front housing 120 is mechanically coupled to the module stack 123 at the front side 164 of the module stack 123. For example, the rear end 162 of the front housing 120 may couple to the module stack 123 at (or proximate to) the front side 164. The front housing 120 projects forward from the module stack 123. For example, the front end 160 of the front housing 120 may define the mating end 128 of the receptacle assembly 102.

The signal conductors have signal contacts 125 (shown in FIG. 4) that project from the front side 164 (FIG. 2) of the module stack 123 and extend into the front housing 120, such that the front housing 120 surrounds the signal contacts 125. The signal contacts 125 within the front housing 120 are configured to engage header signal contacts 144 of the header assembly 104 (also referred to herein as mating contacts 144) when mated. For example, the front housing 120 defines cavities 132 through the front housing 120. The cavities 132 are open along the front end 160. The signal contacts 125 that project from the module stack 123 may extend at least partially into the cavities 132 (without protruding beyond the front end 160). During mating, the header signal contacts 144 of the header assembly 104 are received within corresponding cavities 132 of the front housing 120 through the front end 160, and engage the respective signal contacts 125 therein.

In addition to the cavities 132, the front housing 120 may define ground slots 134 that are configured to receive header ground shields 146 therein during mating. The cavities 132 and the ground slots 134 are open at the front end 160 of the front housing 120 to allow the header signal contacts 144 and header ground shields 146 access into the cavities 132 and ground slots 134, respectively. Optionally, the front end 160 of the front housing 120 may define a planar or relatively planar face 168, referred to herein as a mating face 168, through which the cavities 132 and ground slots 134 extend.

The contact modules 122 may include ground frames 170 (shown in FIG. 4) that have extensions 172 (e.g., beams or fingers) that project beyond the front side 164 (FIG. 2) of the module stack 123. The extensions 172 project at least partially into the ground slots 134 (without protruding beyond the front end 160). During mating, header ground shields 146 may be received into the corresponding ground slots 134 through the front end 160, where the header ground shields 146 engage the extensions 172 to electrically common the receptacle and header assemblies 102, 104. The front housing 120 may be manufactured from a dielectric material, such as a plastic material, that provides electrical insulation or isolation between the cavities 132 and the ground slots 134. For example, the front housing 120 isolates each set of mated receptacle and header signal contacts 125, 144 from other sets of mated receptacle and header signal contacts 125, 144.

The header assembly 104 has a mating end 150 and a mounting end 152 that is mounted to the circuit board 108. The header assembly 104 includes a header housing 138 that has a base 148 and walls 140 that extend from the base 148 to the mating end 150. The walls 140 define a chamber 142 therebetween. The base 148 has a mating surface 154 that defines a back end of the chamber 142 (e.g., the portion of the chamber 142 closest to the mounting end 152). For example, the base 148 may define the mounting end 152 along a surface of the base 148 that is opposite the mating surface 154. The mating surface 154 of the base 148 is recessed from the mating end 150 of the header assembly 104, which is defined by the walls 140. The mating surface 154 may be planar. The header housing 138 may be manufactured from a dielectric material, such as a plastic material.

The header signal contacts 144 and the header ground shields 146 extend from the mating surface 154 of the base 148 into the chamber 142. The header ground shields 146 provide electrical shielding around corresponding header signal contacts 144. The header signal contacts 144 may be arranged in rows and columns on the header assembly 104. In an exemplary embodiment, the header signal contacts 144 are arranged in pairs configured to convey differential signals. The header ground shields 146 peripherally surround a corresponding pair of the header signal contacts 144. In the illustrated embodiment, the header ground shields 146 are C-shaped, covering three sides of the pair of header signal contacts 144.

The receptacle assembly 102 is configured to be received in the chamber 142 through the mating end 150. The front housing 120 engages the walls 140 to hold the receptacle assembly 102 in the chamber 142. As the receptacle assembly 102 is loaded into the chamber 142, the front housing 120 moves towards the base 148. The header signal contacts 144 enter corresponding cavities 132 in the front housing 120, and the header ground shields 146 enter corresponding ground slots 134.

Figure 2:
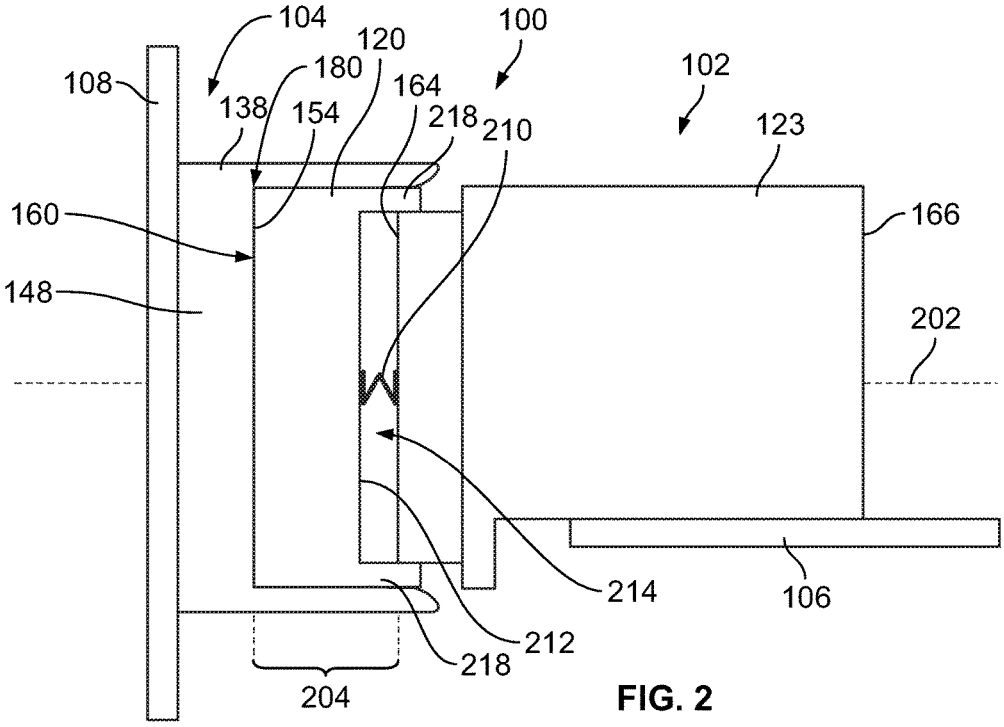
FIG. 2 is a schematic cross-sectional illustration of the connector system showing the receptacle and header connector assemblies mated and a front housing of the receptacle connector assembly in an extended position according to an embodiment.
Figure 3:
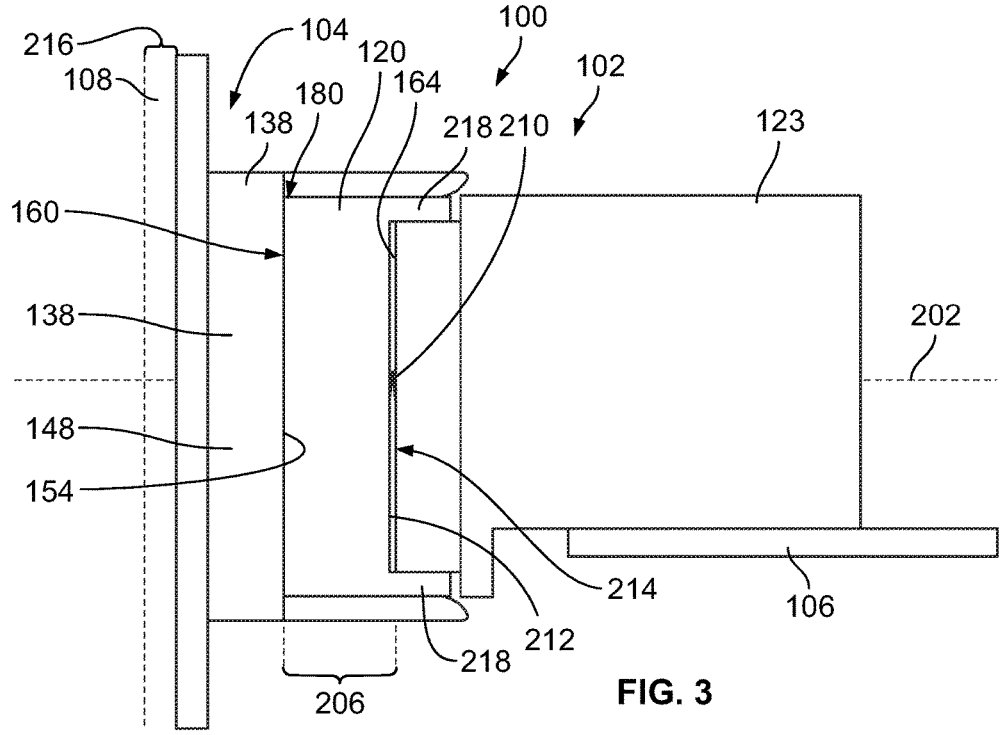
FIG. 3 is a schematic cross-sectional illustration of the connector system showing the receptacle and header connector assemblies mated and the front housing of the receptacle connector assembly in a retracted position according to an embodiment.

In one or more embodiments described herein, the front housing 120 of the receptacle assembly 102 is movable (e.g., translatable) relative to the module stack 123 between an extended position and a retracted position. The front housing 120 is biased towards the extended position, such that the front housing 120 is in the extended position at a resting state (e.g., when no external forces are exerted on the front housing 120). For example, the front housing 120 is in the extended position in the illustrated embodiment since the receptacle assembly 102 is unmated. The front housing 120 in the extended state projects farther away from the module stack 123 than in the retracted state (e.g., although the front housing 120 remains coupled to the module stack 123 in both the extended and retracted positions). The front housing 120 is movable relative to the module stack 123 to enable the front end 160 of the front housing 120 to abut against the mating surface 154 of the base 148 when the assemblies 102, 104 are mated, even when system tolerances or imperfections would otherwise cause an air gap between the front end 160 and the mating surface 154. As shown in FIGS. 2 and 3, the front end 160 of the front housing 120 abuts the mating surface 154 of the base 148 at a mating interface 180, preventing an air gap at the mating interface 180.

FIG. 2 is a schematic cross-sectional illustration of the connector system 100 showing the receptacle and header assemblies 102, 104 mated and the front housing 120 of the receptacle assembly 102 in the extended position according to an embodiment. FIG. 3 is a schematic cross-sectional illustration of the connector system 100 showing the receptacle and header assemblies 102, 104 mated and the front housing 120 of the receptacle assembly 102 in the retracted position according to an embodiment.

The receptacle assembly 102 extends along a longitudinal axis 202 from the front end 160 of the front housing 120 to the rear side 166 of the module stack 123. The longitudinal axis 202 may be parallel to the mating axis 110 (FIG. 1). The front housing 120 is configured to move or float relative to the module stack 123 parallel to (e.g., along) the longitudinal axis 202 between the extended position and the retracted position. In the extended position of the front housing 120 shown in FIG. 2, the front housing 120 projects farther away from the module stack 123 than in the retracted position of the front housing 120 shown in FIG. 3. For example, a first length 204 between the front end 160 of the front housing 120 and the front side 164 of the module stack 123 when the front housing 120 is in the extended position is greater than a second length 206 defined between the same components when the front housing 120 is in the retracted position.

The receptacle assembly 102 includes a spring member 210 that engages both the front housing 120 and the module stack 123. The spring member 210 is disposed between the front housing 120 and the module stack 123. The spring member 210 exerts a biasing force on the front housing 120 in a direction away from the module stack 123 to bias the front housing 120 towards the extended position. The illustration of the spring member 210 in FIG. 2 may be merely a schematic insignia that does not represent an actual shape of the spring member 210 in one or more embodiments. The spring member 210 may be resiliently deflectable and/or compressible to allow the front housing 120 to float along the longitudinal axis 202 while exerting a biasing force on the front housing 120. The spring member 210 in the illustrated embodiment is disposed between and engages the front side 164 of the module stack 123 and a back side 212 of the front housing 120. The spring member 210 forces the front housing 120 and the module stack 123 in opposite directions. The module stack 123 may be stationary due to secured mounting to the circuit board 106, such that the biasing force may only cause movement of the front housing 120.

Due to various reasons (e.g., assembly inaccuracies, manufacturing imperfections, and/or aggregated tolerances, etc.), the circuit board 108 and the header assembly 104 are located closer to the module stack 123 and the circuit board 106 in the position shown in FIG. 3 than in the position shown in FIG. 2 by a distance 216. In known connector assemblies, the connector assemblies may fully mate to one another when in the closer position shown in FIG. 3, but may only partially mate when farther away, as in FIG. 2, resulting in an air gap at the interface between the header housing and the receptacle housing. The air gap may cause an impedance discontinuity along the signal transmission path because air has a different impedance than the dielectric materials that form the receptacle and header housings. Such an impedance discontinuity may cause an impedance spike that negatively affects signal transmission performance, especially at higher signal speeds of at least 10 Gb/s or at least 20 Gb/s.

The connector system 100 according to the embodiments described herein is configured to eliminate, or at least significantly reduce, the air gap at the mating interface 180 between the receptacle connector assembly 102 and the header connector assembly 104 to improve signal transmission performance across the interface 180. For example, the header assembly 104 in FIG. 2 is at a different location relative to the module stack 123 and the circuit board 106 than in FIG. 3, but the front end 160 of the front housing 120 of the receptacle assembly 102 abuts the mating surface 154 of the base 148 of the header assembly 104 at the mating interface 180 at each of the locations shown in FIGS. 2 and 3. As a result, there may be no air gap at the mating interface 180, which may improve signal performance across the mating interface 180 by eliminating or reducing the impedance discontinuity between the receptacle and header assemblies 102, 104. The receptacle assembly 102 is configured to provide impedance control at the mating interface 180 by using the movable front housing 120 to eliminate (or at least significantly reduce) the air gap at the mating interface 180.

During the mating operation, the header assembly 104 may force the front housing 120 from the extended position towards the retracted position. For example, as the receptacle and header assemblies 102, 104 are moved towards each other, the mating surface 154 of the base 148 abuts the front end 160 of the front housing 120 that is in the extended position, as shown in FIG. 2. If the circuit boards 106, 108 are able to be moved closer together than the relative positions shown in FIG. 2, such as to the relative positions shown in FIG. 3, then the header housing 138 of the header assembly 104 moves towards the circuit board 106 and the module stack 123, forcing the front housing 120 to retract from the extended position. The base 148 of the header housing 138 exerts a force on the front housing 120 that overcomes the biasing force exerted by the spring member 210 on the front housing 120. As a result, the spring member 210 compresses and/or deflects as the front housing 120 retracts towards the retracted position shown in FIG. 3. The spring member 210 is more compressed and/or deflected when the front housing 120 is in the retracted position than in the extended position. Typically, once mating is completed, the front housing 120 is forced between the header housing 138 and the spring member 210 in a position that is between the extended and retracted positions.

The distance that the front housing 120 is movable relative to the module stack 123 between the retracted position and the extended position may be any distance, and may be based on design requirements. In a non-limiting example, the distance of travel may be any distance within a range between about 0.25 mm and 10 mm, such that the distance of travel may be 1 mm, 2 mm, 3 mm, or the like. For example, the front housing 120 in the extended position may be 1 mm offset from the front housing 120 in the retracted position.

In an embodiment, the receptacle assembly 102 includes a gap 214 of variable length between the front housing 120 and the module stack 123. The gap 214 is recessed axially from the mating interface 180 within the receptacle assembly 102. The front housing 120 is able to float or move axially relative to the module stack 123 within the gap 214. For example, the gap 214 between the back side 212 of the front housing 120 and the front side 164 of the module stack 123 is at a maximum length when the front housing 120 is in the extended position shown in FIG. 2, and is at a minimum length when the front housing 120 is in the retracted position shown in FIG. 3. The gap 214 may cause an impedance discontinuity along the signal transmission path, but the receptacle assembly 102 is better able to control impedance within the receptacle assembly 102 than at the mating interface 180. For example, the receptacle assembly 102 may include parts of the front housing 120 that extend rearward across the gap 214 even when the front housing 120 is in the extended position, such as shroud walls 218, extensions (not shown) along the back side 212, and/or the like. Additionally, or alternatively, the module stack 123 may include parts or features that extend forward across the gap 214.

Figure 4:
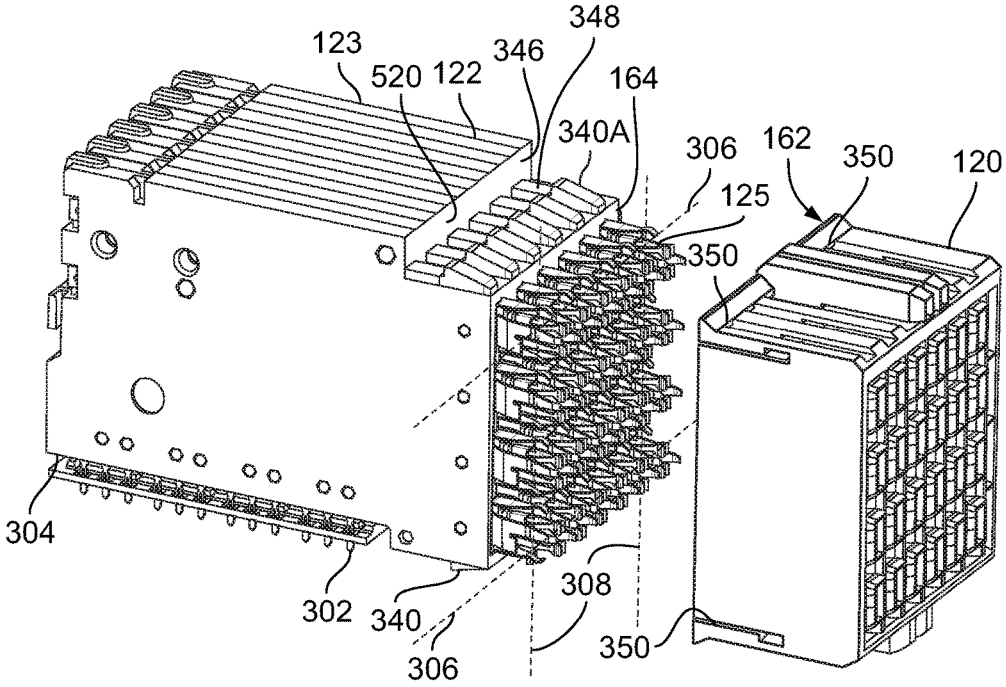
FIG. 4 is an exploded perspective view of the receptacle connector assembly showing the front housing poised for coupling to a module stack according to an embodiment.

FIG. 4 is an exploded perspective view of the receptacle assembly 102 showing the front housing 120 poised for coupling to the module stack 123. The signal contacts 125 project from the front side 164 of the module stack 123. The signal conductors extend from the signal contacts 125 through the module stack 123 to contact tails 302 that project from the module stack 123 at a bottom side 304 of the module stack 123, which represents the mounting end 130 of the receptacle assembly 102. The contact tails 302 may be pins, such as eye-of-the-needle pins, that get through-hole mounted to the circuit board 106 (shown in FIG. 1). The signal contacts 125 may be arranged in a matrix of rows 306 and columns 308. In the illustrated embodiment, the rows 306 are oriented horizontally and the columns 308 are oriented vertically. The signal contacts 125 within the same column 308 are held within a common contact module 122. The signal contacts 125 within each row 306 are provided in multiple contact modules 122. Other orientations are possible in alternative embodiments. Any number of signal contacts 125 may be provided in the rows 306 and columns 308.

Figure 5:
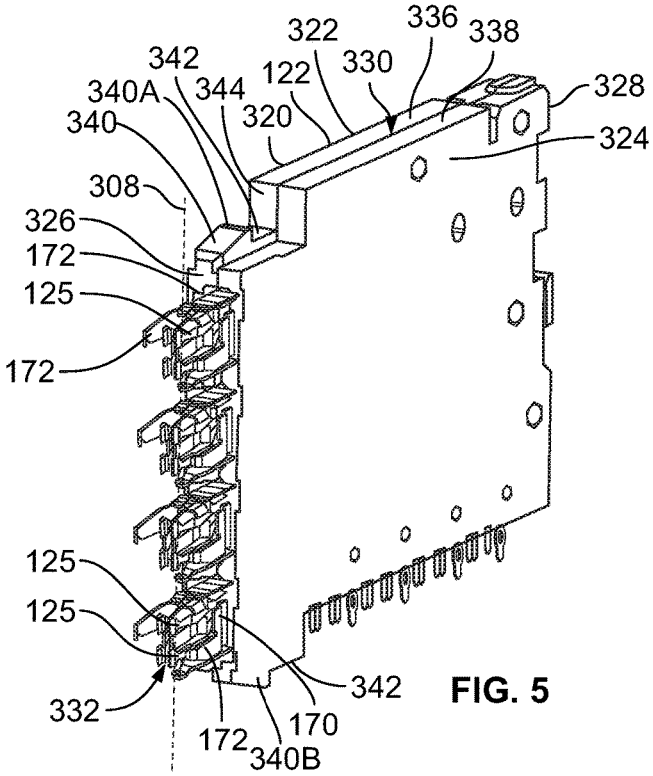
FIG. 5 is a perspective view of one contact module of the module stack according to an embodiment.

FIG. 5 is a perspective view of one of the contact modules 122 according to an embodiment. The contact module 122 shown in FIG. 5 may be representative of all of the contact modules 122 in the module stack 123 shown in FIG. 4. The contact module 122 includes a shell 320 that encases the signal conductors and the ground frames 170. Optionally, the shell 320 may be electrically conductive, such as composed of one or more metals. Alternatively, the shell 320 may be composed of a dielectric material that is electrically insulative. In the illustrated embodiment, the shell 320 is defined by a first shell member 336 and a second shell member 338 that are coupled to one another at an interface 330. The shell 320 has a first side 322 and a second side 324 that is opposite the first side 324. The first and second sides 322, 324 may be planar and parallel to each other. Each of the first and second sides 322, 324 extend from a front edge 326 of the contact module 122 to a rear edge 328. The front side 164 of the module stack 123 (shown in FIG. 4) is defined by the front edges 326 of the contact modules 122 that are stacked side by side.

The contact module 122 includes one or more ground frames 170 within the shell 320 that provide shielding for the signal conductors. The ground frames 170 have extensions 172 (e.g., beams or fingers) that project beyond the front edge 326 of the shell 320 and surround the signal contacts 125. The signal contacts 125 of the contact module 122 may be arranged in pairs 332 carrying differential signals. In the illustrated embodiment, the signal contacts 125 in each pair 332 are arranged in the same column 308 (pair-in-column arrangement) of the matrix (shown in FIG. 4); however, in alternative embodiments, the pairs 332 of signal contacts 125 may be arranged in the same row 306 (pair-in-row arrangement).

The contact module 122 may include one or more latching members 340 along the shell 320. Each latching member 340 projects outward from exterior surfaces 342 of the contact module 122 proximate to the front edge 326. In the illustrated embodiment, the contact module 122 includes an upper latching member 340A along a top of the contact module 122 and a lower latching member 340B along a bottom of the contact module 122. The latching members 340 in the illustrated embodiment are ramped outward. The shell 320 also includes a shoulder 344 that is recessed rearward from the upper latching member 340A and separated from the latching member 340 by a length of the exterior surface 342.

Figure 7:
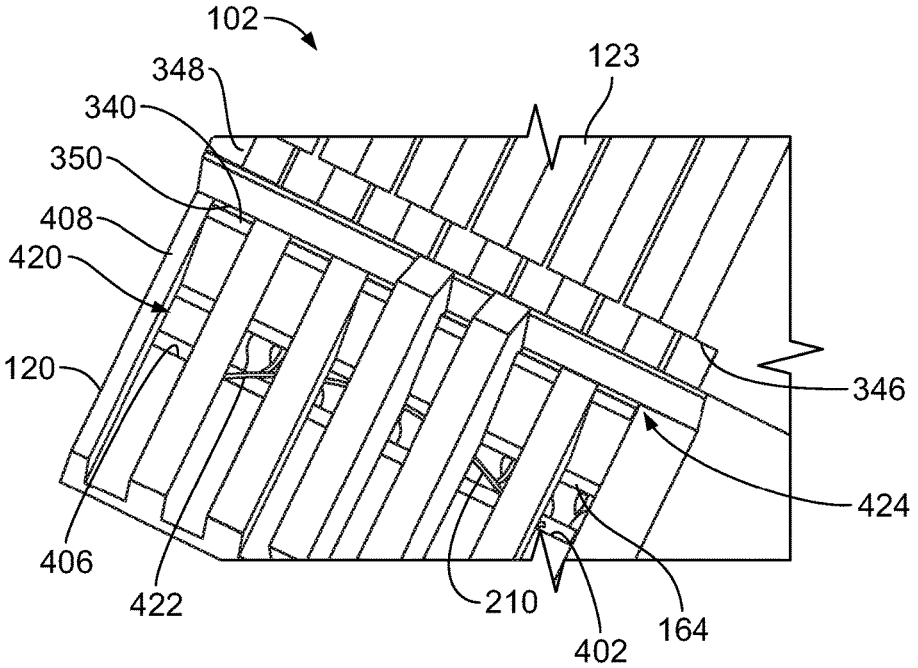
FIG. 7 is a top perspective view of a portion of the receptacle connector assembly according to an embodiment showing the front housing in the extended position.
Figure 8:
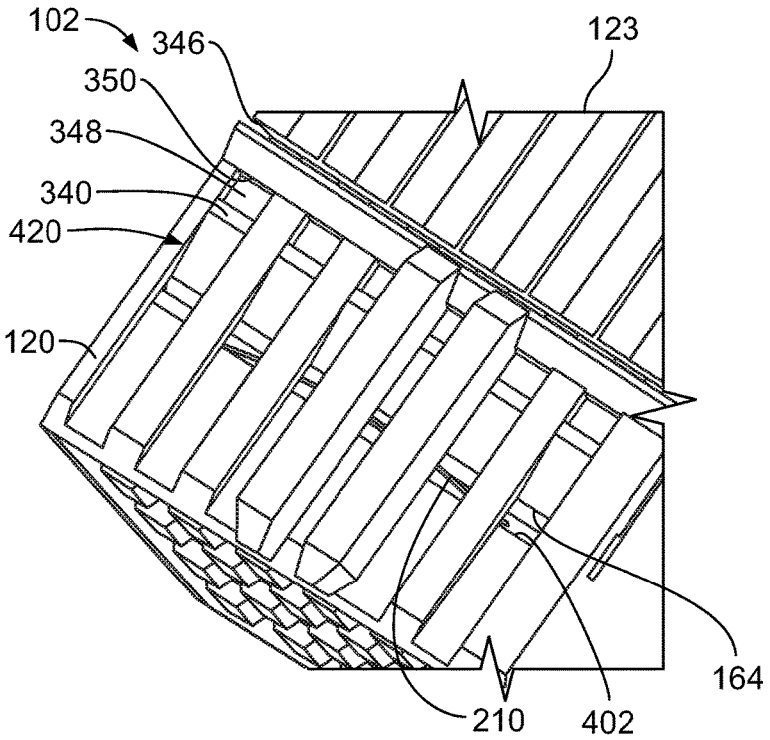
FIG. 8 is a top perspective view of the portion of the receptacle connector assembly according to the embodiment of FIG. 7 showing the front housing in the retracted position.

Referring now back to FIG. 4, when the contact modules 122 are stacked to define the module stack 123, the shoulders 344 define a back wall 346. The back wall 346 is spaced apart from the upper latching members 340A by a shelf 348 that is defined along the exterior surfaces 342 of the individual contact modules 122. The front housing 120 includes latching members 350 at or proximate to the rear end 162 of the front housing 120. The latching members 350 are configured to engage the latching members 340 of the module stack 123 to couple the front housing 120 to the module stack 123. As used herein, the latching members 350 of the front housing 120 may be referred to as first latching members 350, and the latching members 340 of the module stack 123 may be referred to as second latching members 340. The first and second latching members 350, 340 are complementary to one another, as shown in FIGS. 7 and 8. The first latching members 350 of the front housing 120 are configured to move along the shelf 348 between the back wall 346 and the second latching members 340 as the front housing 120 moves axially between the extended and retracted positions.

Figure 6:
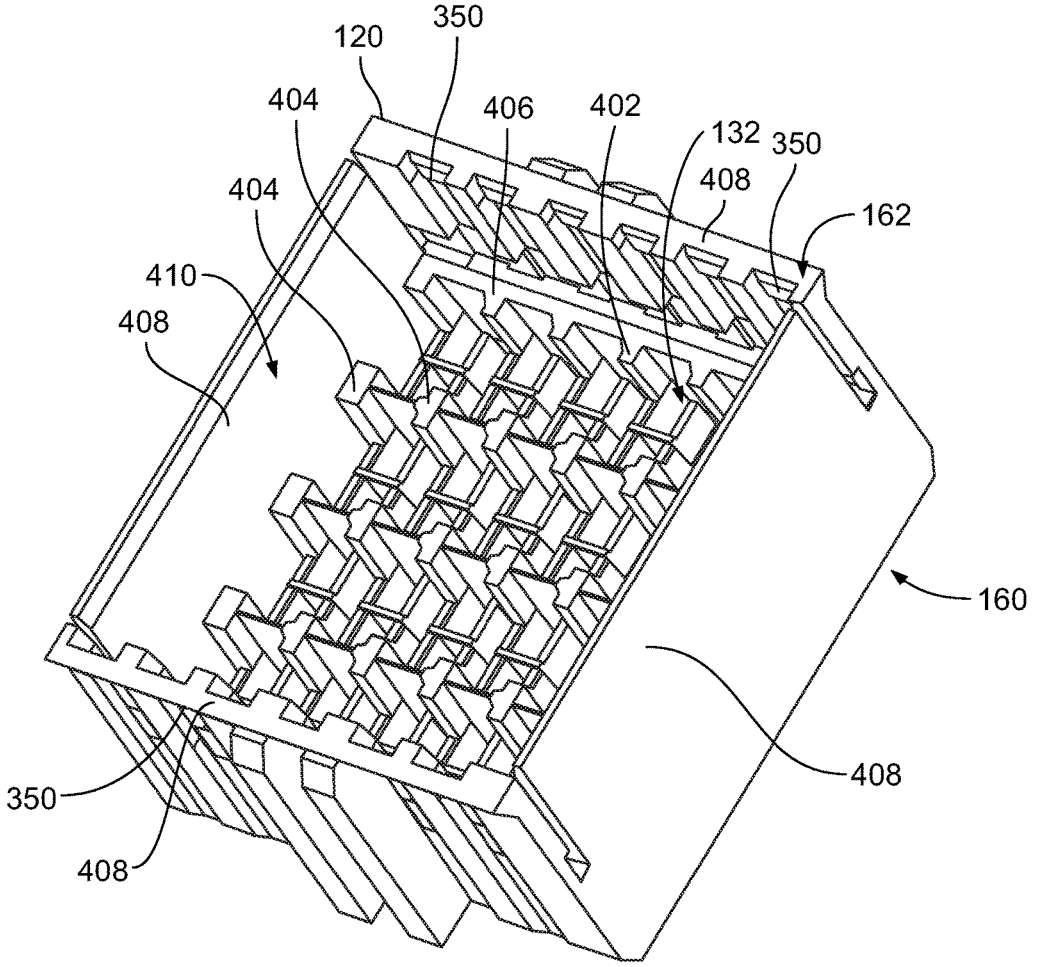
FIG. 6 is a rear perspective view of the front housing of the receptacle connector assembly according to an embodiment.

FIG. 6 is a rear perspective view of the front housing 120 of the receptacle assembly 102 (shown in FIG. 4) according to an embodiment. The cavities 132 of the front housing 120 extend from the front end 160 to a back side 402. The back side 402 is defined by landing platforms 404 and one or more outer ledges 406. The front housing 120 also includes shroud walls 408 that extend rearward beyond the back side 402 to the rear end 162 of the front housing 120. The shroud walls 408 define the rear end 162. The front housing 120 in the illustrated embodiment includes four shroud walls 408 that define a recess 410 between the rear end 162 and the back side 402 (and the cavities 132). The first latching members 350 are disposed along the shroud walls 408 proximate to the rear end 162. When the front housing 120 is coupled to the module stack 123 (shown in FIG. 4), the shroud walls 408 extend along and surround exterior surfaces of the module stack 123. The front side 164 (FIG. 4) of the module stack 123 is received within the recess 410.

FIG. 7 is a top perspective view of a portion of the receptacle assembly 102 according to an embodiment showing the front housing 120 in the extended position. FIG. 8 is a top perspective view of the portion of the receptacle assembly 102 according to the embodiment of FIG. 7 showing the front housing 120 in the retracted position. In the illustrated embodiment, the first latching members 350 of the front housing 120 are adjacent to, or include, slots 420 through the respective shroud wall 408. When the front housing 120 is coupled to the module stack 123, the second latching members 340 of the module stack 123 are received within corresponding slots 420. The first latching members 350 of the front housing 120 are disposed between the second latching members 340 and the back wall 346 of the module stack 123. The first latching members 350 are disposed along the shelf 348 and optionally may engage the shelf 348.

In the illustrated embodiment, the spring member 210 is a leaf spring that includes a curved strip 422. The curved strip 422 may be composed of a metal material or another rigid and resilient material. The leaf spring 210 is configured to compress and deform by flattening out. The leaf spring 210 in the illustrated embodiment is disposed between and engages the back side 402 of the front housing 120 and the front side 164 of the module stack 123. For example, the leaf spring 210 may be held on the outer ledge 406 of the front housing 120 that is also shown in FIG. 6. The leaf spring 210 exerts a biasing force on the front housing 120 that moves the front housing 120 relative to the module stack 123 to the extended position shown in FIG. 7. Although the leaf spring 210 forces the front housing 120 away from the module stack 123, the first latching members 350 of the front housing 120 abut against the second latching members 340 of the module stack 123 to block additional movement of the front housing 120 beyond the extended position. For example, the first and second latching members 350, 340 provide a hard stop interface 424 that retains the front housing 120 on the module stack 123 against the biasing force of the leaf spring 210. The front housing 120 may achieve the extended position when the first latching members 350 abut the second latching members 340 at the hard stop interface 424.

As shown in FIG. 8, as the header assembly 104 (shown in FIG. 1) engages the front housing 120 during mating, the front housing 120 is forced by the header assembly 104 towards the module stack 123 such that the first latching members 350 move along the shelf 348 of the module stack 123 towards the back wall 346. The second latching members 340 of the module stack 123 are at different locations within the slots 420 in the retracted position of the front housing 120 relative to the extended position shown in FIG. 7. As shown in FIG. 8, the second latching members 340 are spaced apart from the first latching members 350 of the front housing 120. The leaf spring 210 compresses (e.g., by flattening out) as the distance between the back side 402 of the front housing 120 and the front side 164 of the module stack 123 decreases. The leaf spring 210 exerts a biasing force on the front housing 120, even when compressed, such that the leaf spring 210 resiliently forces the front housing 120 back towards the extended position once the header assembly 104 is unmated from the receptacle assembly 102.

Figure 9:
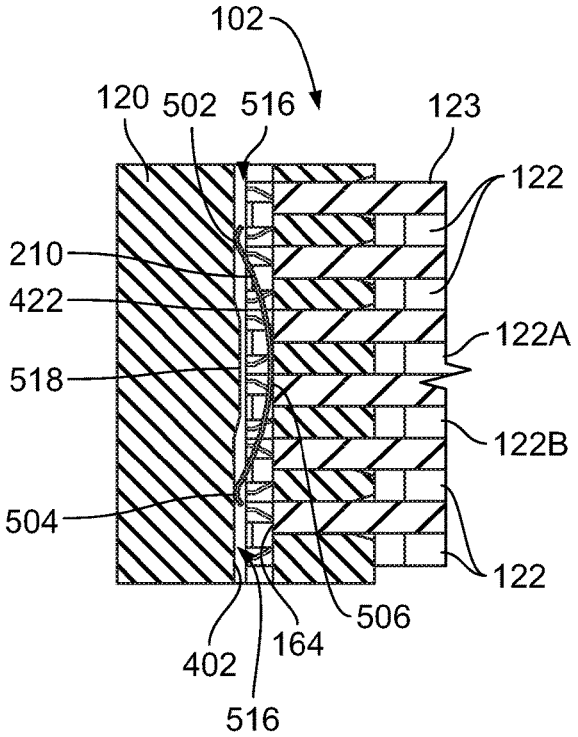
FIG. 9 is a cross-sectional top down view of a portion of the receptacle connector assembly according to the embodiment shown in FIGS. 7 and 8.

FIG. 9 is a cross-sectional top down view of a portion of the receptacle assembly 102 according to the embodiment shown in FIGS. 7 and 8. The front housing 120 is in the extended position in FIG. 9. The curved strip 422 of the leaf spring 210 extends between first and second ends 502, 504. In the illustrated embodiment, the first and second ends 502, 504 engage the back side 402 of the front housing 120. The curved strip 422 has an intermediate segment 506 between the ends 502, 504 that engages the front side 164 of the module stack 123. In the illustrated embodiment, the leaf spring 210 is oriented to extend across the contact modules 122 in the module stack 123. The intermediate segment 506 may engage multiple contact modules 122 in the module stack 123. For example, the intermediate segment 506 engages two inner contact modules 122A, 122B in the illustrated embodiment. In the extended position of the front housing 120, the leaf spring 210 may be pre-loaded such that the leaf spring 210 exerts the biasing force on the front housing 120. As the leaf spring 210 compresses due to movement of the front housing 120 towards the retracted position, the leaf spring 210 may flatten such that the intermediate segment 506 engages additional contact modules 122 in the module stack 123. In an alternative embodiment, the leaf spring 210 may be flipped such that the ends 502, 504 engage the module stack 123 and the intermediate segment 506 engages the back side 402 of the front housing 120.

Figure 10:
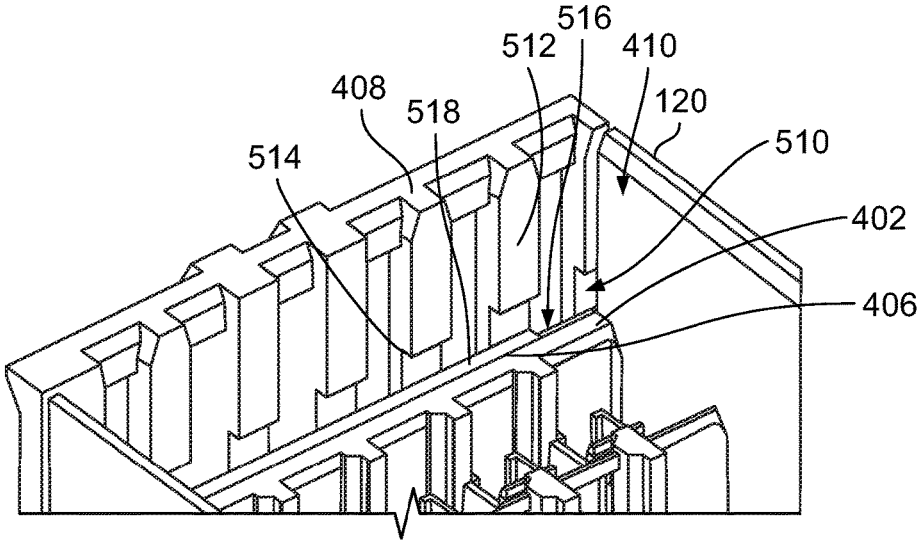
FIG. 10 is a rear perspective view of a portion of the front housing according the embodiment shown in FIGS. 7-9.

FIG. 10 is a rear perspective view of a portion of the front housing 120 according the embodiment shown in FIGS. 7-9. In the illustrated embodiment, the front housing 120 defines a cutout compartment 510 along an inner surface 512 of one of the shroud walls 408. The cutout compartment 510 may be located at the outer ledge 406 (also shown in FIG. 6) along the back side 402. Although not shown in FIG. 10, the leaf spring 210 (FIG. 9) may be mounted to the front housing 120 within the cutout compartment 510. The leaf spring 210 may be held in the cutout compartment 510 such that the ends 502, 504 (FIG. 9) engage the outer ledge 406 and the intermediate segment 506 engages an overhang shoulder 514 along the shroud wall 408. The leaf spring 210 may protrude inwardly beyond the inner surface 512 of the shroud wall 408 into the recess 410 of the front housing 120 to engage the module stack 123 (FIG. 9). With additional reference to FIG. 9, the outer ledge 406 optionally defines grooves 516 on either side of a raised portion 518 to limit lateral movement of the leaf spring 210 within the cutout compartment 510.

With additional reference to FIG. 4, the leaf spring 210 within the cutout compartment 510 along the shroud wall 408 may be configured to engage the front side 164 of the module stack 123 along a perimeter ledge 520 of the front side 164 that is between the signal contacts 125 and an exterior side of the module stack 123.

Although only one leaf spring 210 is shown and described with reference to FIGS. 7-10, the receptacle assembly 102 may include two or more leaf springs 210 mounted within the front housing 120. For example, the receptacle assembly 102 may include two leaf springs 210 that are disposed along opposite sides of the front housing 120.

Figure 11:
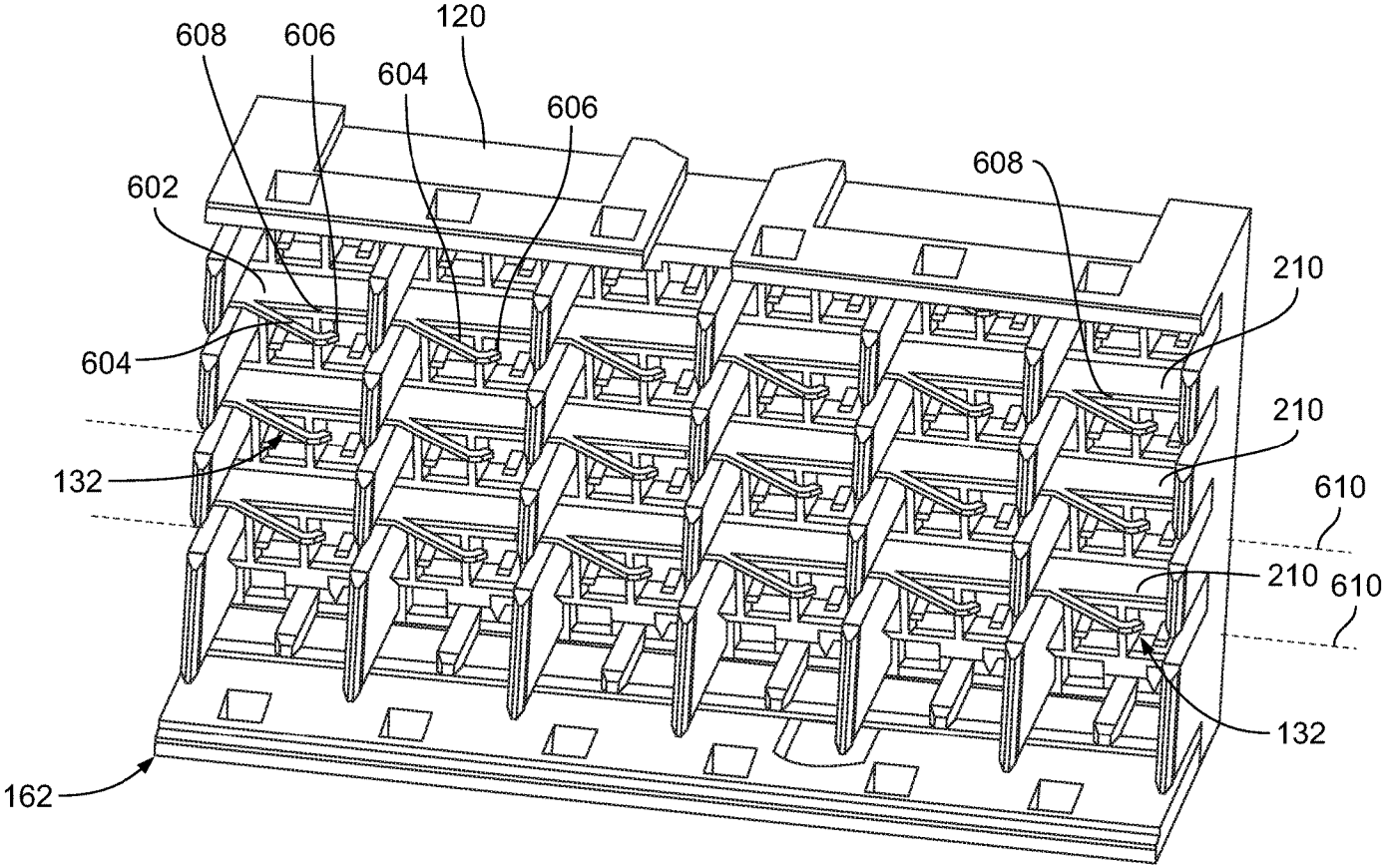
FIG. 11 is a rear perspective view of the front housing of the receptacle connector assembly according to another embodiment of the present disclosure.

FIG. 11 is a rear perspective view of the front housing 120 of the receptacle assembly 102 (shown in FIG. 1) according to another embodiment of the present disclosure. Like the embodiment shown in FIGS. 7-10, the spring member 210 in the illustrated embodiment is mounted to the front housing 120. Unlike the leaf spring 210 shown in FIGS. 7-9, the spring member 210 in the illustrated embodiment includes a bar 602 with multiple spring beams 604 that extend from the bar 602. The spring beams 604 are cantilevered from the bar 602 such that each spring beam 604 extends from the bar 602 to a respective distal end 606 of the spring beam 604 that is spaced apart from the bar 602. The bar 602 may be an elongated planar strip. The spring beams 604 extend from a rear edge 608 of the bar 602 rearward towards the rear end 162 of the front housing 120.

In the illustrated embodiment, the front housing 120 holds three spring members 210, but may hold more or less than three spring members 210 in other embodiments. The spring members 210 may be identical copies of one another. The spring members 210 may be oriented laterally parallel to rows 610 of the cavities 132. Each of the rows 610 aligns with a different row 306 (shown in FIG. 4) of the signal contacts 125 (FIG. 4). The three spring members 210 may be oriented parallel to one another. Some of the spring members 210 are disposed between adjacent rows 610 of the cavities 132. In the illustrated embodiment, all three of the spring members 210 are disposed between different adjacent rows 610 of the cavities 132.

Figure 12:
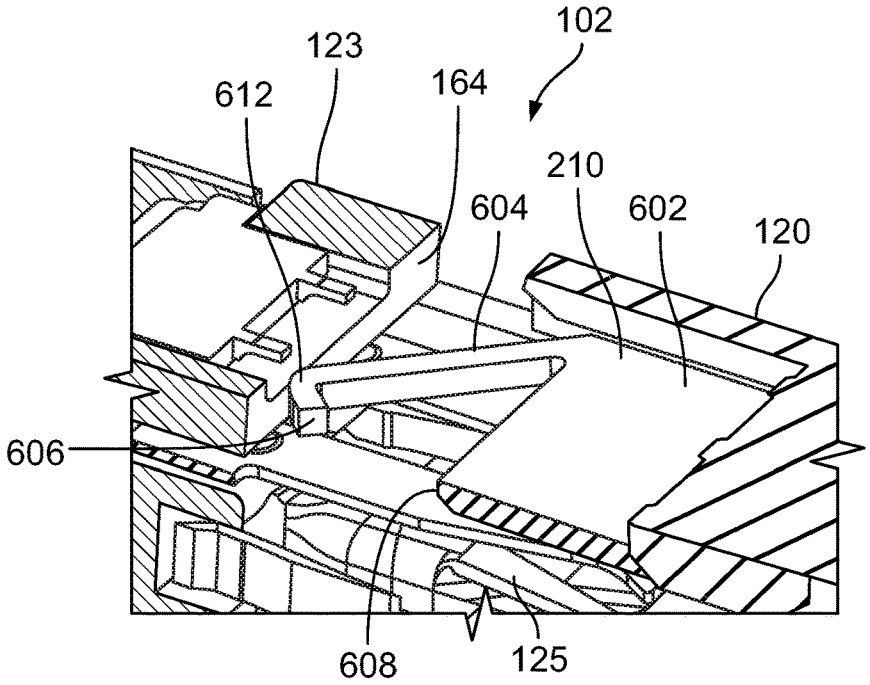
FIG. 12 is a close-up cross-sectional view of a portion of the receptacle connector assembly according to the embodiment of FIG. 11 showing the front housing in the extended position.
Figure 13:
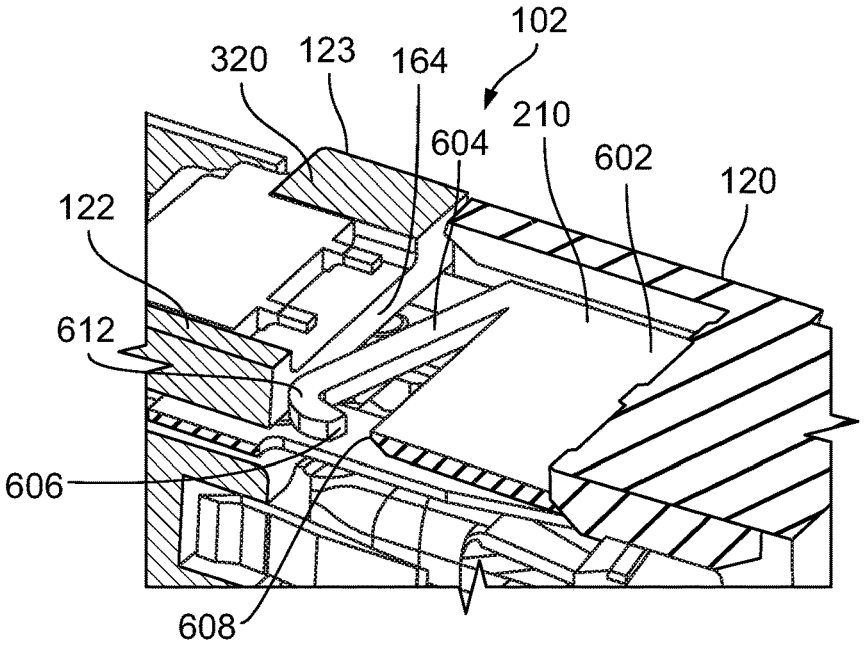
FIG. 13 is a close-up cross-sectional view of the portion of the receptacle connector assembly in FIG. 12 showing the front housing in the retracted position.

FIG. 12 is a close-up cross-sectional view of a portion of the receptacle assembly 102 according to the embodiment shown in FIG. 11 showing the front housing 120 in the extended position. FIG. 13 is a close-up cross-sectional view of the portion of the receptacle assembly 102 in FIG. 12 showing the front housing 120 in the retracted position. FIGS. 12 and 13 only show one spring beam 604 of one of the spring members 210, but the visible spring beam 604 may be representative of the other spring beams 604 of the same and other spring members 210. The spring beam 604 includes a contact segment 612 proximate to the distal end 606. The contact segment 612 engages the module stack 123 to bias the front housing 120 towards the extended position. The contact segment 612 may be a bump or convexity that is configured to prevent stubbing on the module stack 123. Specifically, the contact segment 612 may engage the front side 164 of the module stack 123. For the spring member 210 that are mounted to the front housing 120 between rows 610 of the cavities 132, as shown in FIG. 11, the spring beams 604 may engage the front side 164 between adjacent rows 306 (FIG. 4) of the signal contacts 125.

As shown in FIG. 13, as the front housing 120 moves towards the retracted position, the spring beam 604 deflects and the contact segment 612 slides along the front side 164 of the module stack 123. The spring beam 604 deflects such that the distal end 606 is located closer to the rear edge 608 of the bar 602 in the retracted position shown in FIG. 13 than in the extended position shown in FIG. 12. Optionally, the shells 320 of the contact modules 122 may be electrically conductive, such that the engagement between the spring beams 604 and the shells 320 may provide a ground connection that electrically commons the spring members 210 to the module stack 123.

Figure 14:
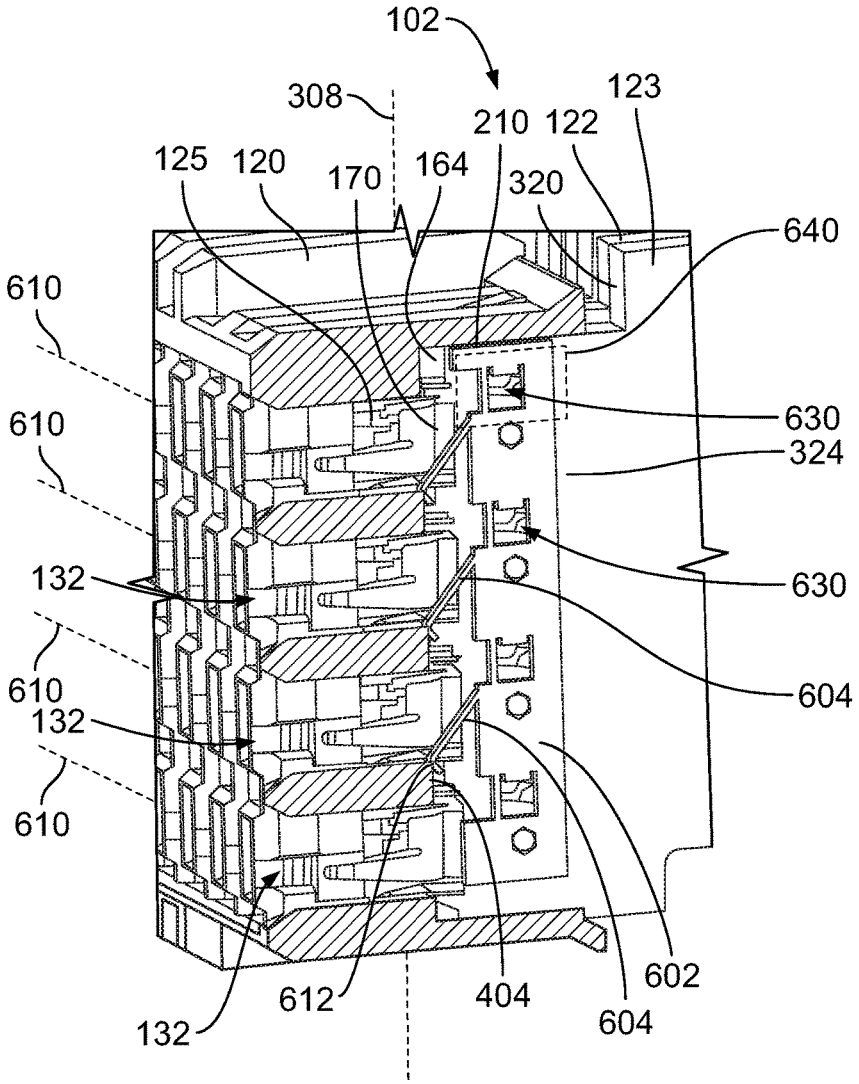
FIG. 14 is a transverse cross-sectional view of a portion of the receptacle connector assembly according to another embodiment of the present disclosure.

FIG. 14 is a transverse cross-sectional view of a portion of the receptacle assembly 102 according to another embodiment of the present disclosure. The front housing 120 is shown in the extended position. In the illustrated embodiment, the spring member 210 is mounted to the module stack 123. The spring member 210 includes a bar 602 and spring beams 604 that project from the bar 602, like the spring member 210 shown in FIGS. 11-13. Unlike the spring member 210 shown in FIGS. 11-13, the spring member 210 in the illustrated embodiment is oriented vertically instead of laterally. For example, the spring member 210 may be oriented parallel to the columns 308 of signal contacts 125 (e.g., perpendicular to the rows 306 shown in FIG. 4). The spring member 210 may be mounted to the module stack 123 such that the bar 602 engages the module stack 123 proximate to the front side 164, and the spring beams 604 project forward beyond the front side 164 to engage the front housing 120 and bias the front housing 120 towards the extended position. In the illustrated embodiment, contact segments 612 of the spring beams 604 engage corresponding landing platforms 404 of the front housing 120 (also shown in FIG. 6). The landing platforms 404 may be located between the cavities 132 in adjacent rows 610.

In the illustrated embodiment, the bar 602 of the spring member 210 is mounted against the second side 324 of one of the contact modules 122 in the module stack 123. The contact module 122 that is mounted to the spring member 210 optionally may be an outermost contact module 122 in the stack 123, but may be an interior contact module 122 in the stack 123 in an alternative embodiment. In the illustrated embodiment, the contact module 122 defines apertures 630 that extend through the shell 320 along the second side 324. The bar 602 aligns with the apertures 630. Although not shown, the receptacle assembly 102 optionally may include multiple spring members 210 that are coupled to multiple different contact modules 122 in the module stack 123.

Figure 15:
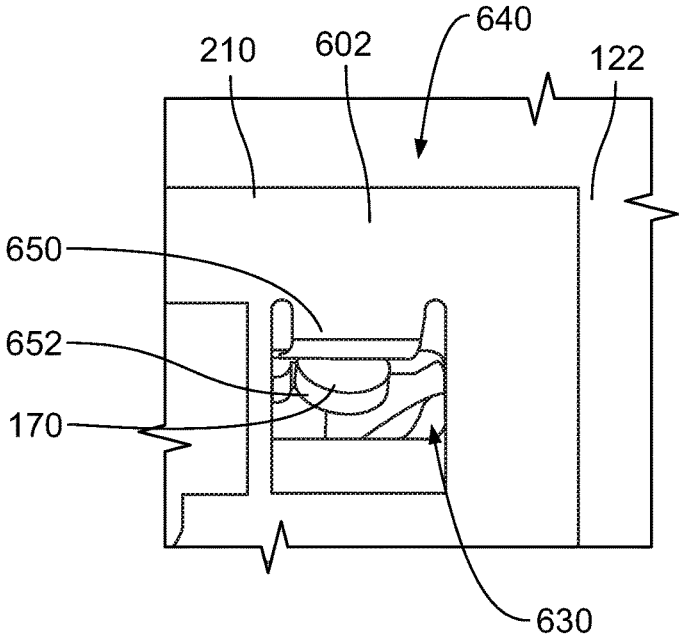
FIG. 15 is a close-up view of a portion of the receptacle connector assembly shown in FIG. 14.

FIG. 15 is a close-up view of a portion 640 of the receptacle assembly 102 shown in FIG. 14. As shown in FIG. 15, the bar 602 of the spring member 210 may include a tab 650 that extends inwardly through a corresponding one of the aperture 630 in the contact module 122. The tab 650 may engage a component of the ground frame 170 (also shown in FIG. 14) of the contact module 122 to electrically connect the spring member 210 to the ground frame 170. For example, the tab 650 may engage a spring finger 652 of the ground frame 170. Although only one tab 650 is shown in the illustrated portion 640, the bar 602 may include multiple tabs 650 along a length of the bar 602 that extend into multiple apertures 630 along the contact module 122.

Figure 16:
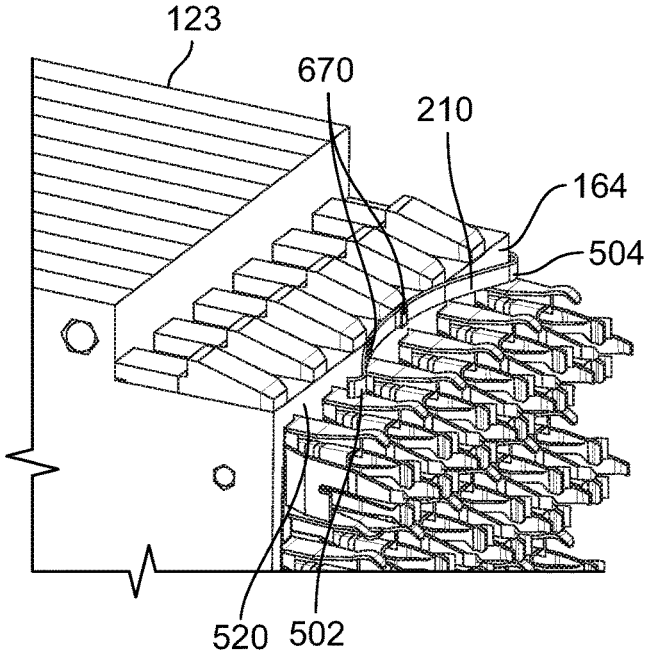
FIG. 16 is a perspective view of a portion of the module stack of the receptacle connector assembly according to yet another embodiment.

FIG. 16 is a perspective view of a portion of the module stack 123 of the receptacle assembly 102 (FIG. 1) according to yet another embodiment. In the illustrated embodiment, the spring member 210 is a leaf spring 210 that is mounted to the module stack 123, instead of being mounted to the front housing 120 as shown in FIGS. 7-10. For example, the leaf spring 210 may be mounted along the perimeter ledge 520 along the front side 164 of the module stack 123. The leaf spring 210 may be secured to the front side 164 via clips 670, as illustrated, or via other means, such as an adhesive or another type of fastener. In the illustrated embodiment, the first and second ends 502, 504 of the leaf spring 210 extend forward and are configured to engage the front housing 120 (FIG. 1) to bias the front housing 120 towards the extended position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly comprising:

a module stack comprising multiple contact modules disposed side by side, the module stack having a front side and a rear side opposite the front side, the module stack including multiple signal contacts that project beyond the front side;

a front housing mechanically coupled to the module stack at the front side and surrounding the signal contacts, the front housing defining cavities that are open along a front end of the front housing, the cavities configured to receive mating contacts of a mating connector through the front end to engage the signal contacts, the front housing movable relative to the module stack along a longitudinal axis of the electrical connector assembly between a retracted position and an extended position; and a spring member held between the module stack and the front housing, the spring member engaging the module stack and the front housing and biasing the front housing towards the extended position.

2. The electrical connector assembly of claim 1, wherein the front end of the housing is disposed farther from the front side of the module stack in the extended position than in the retracted position.

3. The electrical connector assembly of claim 1, wherein, in response to the front end of the front housing engaging a base of the mating connector during a mating operation, the front housing moves from the extended position towards the retracted position and the spring member one or more of compresses or deflects.

4. The electrical connector assembly of claim 1, wherein the spring member is a leaf spring and engages the front side of the module stack to bias the front housing towards the extended position.

5. The electrical connector assembly of claim 1, wherein the spring member is a leaf spring that extends laterally across the module stack and engages a plurality of the contact modules in the module stack.

6. The electrical connector assembly of claim 1, wherein a float distance of the front housing from the retracted position to the extended position is between about 0.25 mm and about 10 mm.

7. The electrical connector assembly of claim 1, wherein the cavities of the front housing extend from the front end to a back side of the front housing, the front housing including shroud walls extending beyond the back side to a rear end of the front housing opposite the front end, wherein the spring member is held between and engages the front side of the module stack and the back side of the front housing such that the spring member is disposed rearward of the cavities.

8. The electrical connector assembly of claim 1, wherein the front housing includes shroud walls extending rearward beyond the cavities to a rear end of the front housing that is opposite the front end, wherein the shroud walls of the front housing include first latching members that engage complementary second latching members on the module stack to mechanically couple the front housing to the module stack, wherein engagement between the first and second latching members provides a hard stop interface that prevents the spring member from moving the front housing beyond the extended position.

9. The electrical connector assembly of claim 1, wherein the front housing includes first latching members that engage complementary second latching members on the module stack to mechanically couple the front housing to the module stack, the second latching members on the module stack projecting outward from an exterior surface of the module stack, the exterior surface defining a shelf that extends rearward from the second latching members, wherein the first latching members of the front housing are received behind the second latching members and move along the shelf as the front housing moves between the extended position and the retracted position.

10. The electrical connector assembly of claim 1, wherein the spring member includes an elongated bar and multiple spring beams extending from the bar to respective distal ends of the spring beams, each of the spring beams including a contact segment proximate to the respective distal end, wherein the bar is secured to a side of one of the contact modules in the module stack, and the spring beams extend beyond the front side of the module stack such that the contact segments engage the front housing to bias the front housing towards the extended position.

11. The electrical connector assembly of claim 1, wherein the spring member includes an elongated bar and multiple spring beams extending from the bar to respective distal ends of the spring beams, each of the spring beams including a contact segment proximate to the respective distal end, wherein the bar is secured to the front housing, and the contact segments of the spring beams engage the front side of the module stack to bias the front housing towards the extended position.

12. The electrical connector assembly of claim 11, wherein the cavities of the front housing are arranged in rows, and the bar of the spring member is mounted to the front housing between adjacent rows of the cavities.

13. An electrical connector assembly comprising:

a module stack comprising multiple contact modules disposed side by side, the module stack having a front side and a rear side opposite the front side, the module stack including multiple signal contacts that project beyond the front side;

a front housing mechanically coupled to the module stack at the front side and surrounding the signal contacts, the front housing defining cavities that are open along a front end of the front housing, the cavities configured to receive mating contacts of a mating connector through the front end to engage the signal contacts, the front housing movable relative to the module stack along a longitudinal axis of the electrical connector assembly between a retracted position and an extended position; and a spring member mounted to the front housing, the spring member extending rearward and engaging the front side of the module stack to bias the front housing towards the extended position.

14. The electrical connector assembly of claim 13, wherein the front housing includes shroud walls extending rearward beyond the cavities to a rear end of the front housing that is opposite the front end, wherein the spring member is a leaf spring that is mounted within a cutout compartment along an inner surface of one of the shroud walls, the spring member protruding from the cutout compartment to engage the module stack.

15. The electrical connector assembly of claim 13, wherein the spring member is a leaf spring and the leaf spring engages the front side of the module stack along a perimeter ledge of the front side that is between the signal contacts and an exterior side of the module stack.

16. The electrical connector assembly of claim 13, wherein the spring member includes an elongated bar and multiple spring beams extending from the bar to respective distal ends of the spring beams, each of the spring beams including a contact segment proximate to the respective distal end, wherein the bar is secured to the front housing, and the contact segments of the spring beams engage the front side of the module stack to bias the front housing towards the extended position.

17. The electrical connector assembly of claim 13, wherein the signal contacts of the module stack are arranged in rows, and the spring member engages the front side of the module stack between adjacent rows of signal contacts.

18. An electrical connector assembly comprising:

a module stack comprising multiple contact modules disposed side by side, the module stack having a front side and a rear side opposite the front side, the module stack including multiple signal contacts that project beyond the front side;

a front housing mechanically coupled to the module stack at the front side and surrounding the signal contacts, the front housing defining cavities that are open along a front end of the front housing, the cavities configured to receive mating contacts of a mating connector through the front end to engage the signal contacts, the front housing movable relative to the module stack along a longitudinal axis of the electrical connector assembly between a retracted position and an extended position; and a spring member mounted to the module stack, the spring member extending forward and engaging the front housing to bias the front housing towards the extended position.

19. The electrical connector assembly of claim 18, wherein the spring member includes an elongated bar and multiple spring beams extending from the bar to respective distal ends of the spring beams, each of the spring beams including a contact segment proximate to the respective distal end, wherein the bar is secured to a side of one of the contact modules in the module stack, and the spring beams extend beyond the front side of the module stack such that the contact segments engage the front housing to bias the front housing towards the extended position.

20. The electrical connector assembly of claim 19, wherein the spring member includes a tab that projects inwardly from the bar through an aperture in the side of the contact module to which the bar is secured.

* * * * *